United States Patent [19]

Guarino et al.

[11] 4,308,056

[45] Dec. 29, 1981

[54] METHOD AND APPARATUS FOR INTRODUCING SOLID SUBSTANCES INTO LIQUID METALS

[75] Inventors: Giovanni Guarino, Axa-Acilia; Alberto Praitoni, Pomezia; Vittorio Saverese, Martina Franca, all of Italy

[73] Assignee: Italsider S.p.A., Genoa, Italy

[21] Appl. No.: 143,766

[22] Filed: Apr. 25, 1980

[30] Foreign Application Priority Data

Apr. 27, 1979 [IT] Italy ..... 48864 A/79

[51] Int. Cl.[3] ..... C21D 1/46; C21B 7/16

[52] U.S. Cl. ..... 75/53; 75/58; 75/93 R; 75/130 R; 266/120; 266/265

[58] Field of Search ..... 75/53, 58, 93, 129, 75/130 R; 266/120, 265

[56] References Cited

U.S. PATENT DOCUMENTS

| | | | |
|---|---|---|---|
| 2,408,466 | 10/1946 | Lyons | 266/120 |
| 3,272,619 | 9/1966 | Sweeney | 75/68 |
| 3,545,960 | 12/1970 | McClellan | 75/129 |
| 3,558,119 | 1/1971 | Demalander | 266/267 |
| 3,729,309 | 4/1973 | Kowawa | 75/53 |
| 3,738,827 | 6/1973 | Pryor | 75/53 |
| 3,768,999 | 10/1973 | Ohkubo | 75/53 |
| 3,915,693 | 10/1975 | Rasmussen | 75/53 |
| 3,926,623 | 12/1975 | Keyser | 75/129 |
| 3,980,469 | 9/1976 | Forster | 75/129 |
| 4,094,666 | 6/1978 | Otatani | 75/53 |
| 4,108,637 | 8/1978 | Hetke | 75/53 |
| 4,174,962 | 11/1979 | Frantzreb | 75/53 |
| 4,175,918 | 11/1979 | Frantzreb | 75/53 |
| 4,191,563 | 3/1980 | Smartt | 75/53 |

*Primary Examiner*—P. D. Rosenberg
*Attorney, Agent, or Firm*—Young & Thompson

[57] ABSTRACT

Solid substances are introduced into a bath of molten metal by pushing a hollow metal tube filled with the solid substance, through a tubular former that imparts a spiral shape to the carrier tube. The spiral rotates about a vertical axis as it descends into the bath of molten metal.

6 Claims, 1 Drawing Figure

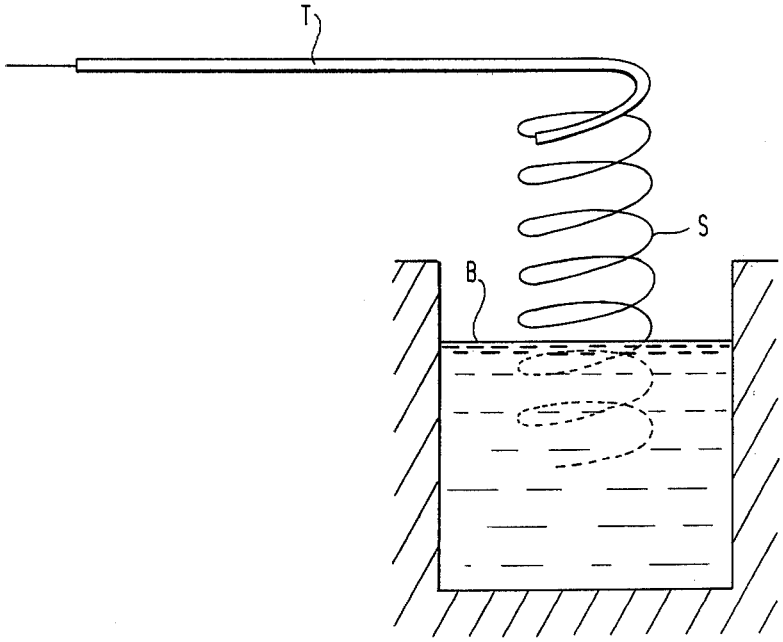
T
S
B

METHOD AND APPARATUS FOR INTRODUCING SOLID SUBSTANCES INTO LIQUID METALS

The present invention relates to methods and apparatus for introducing solid substances into liquid metals, and is an improvement on copending application Ser. No. 38,179, filed May 11, 1979, the disclosure of which is incorporated herein by reference.

In the earlier application, the active substances, such as those used for reducing the sulphur and/or oxygen present in metal baths, and/or for controlling the nature and form of the non-metallic inclusions produced as a result of deoxy-desulphurizing treatments, were added to the bath through a hollow carrier wherein they were present as discrete quantities separated by inert materials. In one particular embodiment, the active substance was interstratified by inert material.

The inert material could be metal sheet, sponge metal or metal powder and the metal could be iron. The inert material could also consist of other compounds, such as inert oxides, e.g. alumina.

The volume of the discrete quantities of active substance could vary between 0.1 and 5 $dm^3$, while the thickness of the inert material could be between 0.1 and 20 mm.

The elongated hollow carrier was made of metal sheet (e.g. iron), the walls of which could if desired be perforated for the outflow of gases, and the carrier could be clad with a layer of refractory material between 0.1 and 50 mm thick. The carrier could be mounted on rods, through which there could flow an inert gas.

The present invention is an improvement on what is described above, in that the active substance in a hollow tubular carrier (with or without spacers of inert material) is introduced into the bath in the form of a spiral that descends and rotates about its vertical axis as it progressively immerses itself in the bath. Good results have been obtained with circular turns of the spiral having a diameter up to 1 m and a pitch of up to 500 mm. The wall thickness of the hollow carrier is less than 20 mm and the inside diameter of the hollow carrier is less than 100 mm. The tubular carrier, filled with active substance, is fed into the bath at any desired rate up to 10 m/sec.

As a result of the use of a cored spiral tube according to the present invention, the following advantages are obtained:

1. The spiral and its manner of movement make it possible for the introduced coil to adapt readily to any surfaces that may be encountered as it is fed into the bath.

2. More uniform distribution of the active substances in the bath is ensured.

3. A more rapid introduction of the material into the metal bath is made possible.

These and other features and advantages of the present invention will become apparent from a consideration of the following description, taken in connection with the accompanying drawing, which is a schematic side elevational view of a spiral carrier according to the present invention, being introduced into a bath of molten steel.

In the drawing, the spiral S enters the bath B, turning about its vertical axis and descending all the while. The spiral form is imparted to what would otherwise be a rectilinear advancing length of carrier, by passing the carrier through a tube T that bends the carrier to spiral shape as it passes through tube T.

In order to enable those skilled in the art to practice the invention, the following illustrative example is given, it being understood that the example is purely for purposes of illustration and is not to be taken as limiting the scope of protection to which the invention is entitled.

EXAMPLE

The illustrative example is in two parts. In the first part, active substance is added to the bath by inserting a straight vertical cored carrier into the bath, in the manner of the above-identified copending application but without the inert spacers of the copending application. In the second part of the example, the present invention is practiced, with a spiral cored carrier, again without inert spacers.

Thus, for the first case, in which the carrier is straight and vertical, a hollow tubular steel tube having a wall thickness of 1 mm and a diameter of 8 mm with a welded seam is filled with calcium-silicon alloy consisting of 20% calcium and 80% silicon, in finely divided form. It is inserted into a bath of steel which is 300 mm deep and contains 15 tons of steel for plates, contained in a continuous casting tundish at a temperature of 1540° C. The carrier is moved downwardly at a constant rate of 4 m/min. and melts on the bottom of the tundish. At higher feed rates, marked erosion of the tundish refractory is noted at the point of contact; while, when the rate is increased still further, the carrier emerges intact from the bath. In that last case, by the use of a straight carrier it was not possible to add the required quantity of active substance to the bath to achieve the desired desulphurizing results on the one hand and to control oxide and sulphide inclusions on the other hand.

The second part of the example, which is the practice according to the present invention, uses the same carrier and the same bath, but passes the carrier through a guide tube T the end part of which has the shape and size of the spiral to be formed. Thus, circular turns of a diameter of 300 mm and a pitch of 100 mm are formed by machinery which includes a horizontal uncoiler (not shown) for feeding a substantially straight length of carrier from a coil thereof, a driven roller device (not shown) for advancing the carrier, and finally the guide tube T. The carrier is advanced at a linear feed rate of 12 m/min. 155 g. of alloy are introduced per ton of steel. This results in there being 25 ppm of calcium as oxide and sulphide inclusions, whose form does not impair the mechanical properties of the steel produced.

The same spiral, introduced by the same method but at a rate in the range of 0.2–0.4 m/sec., has permitted the introduction of 230 g. of active alloy per ton of steel. The formation of inclusions with a higher calcium content than in the previous case was observed.

From a consideration of the foregoing disclosure, it will be evident that the initially recited object of the invention has been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A method for the introduction of a solid substance into a molten metal bath, comprising feeding a hollow tubular carrier containing the said substance into a molten metal bath in the form of a spiral, and rotating the spiral about the axis of the spiral while immersing the spiral in the bath.

2. A method as claimed in claim 1, in which said axis is vertical.

3. A method as claimed in claim 2, and bending the carrier to spiral shape at a point directly above the bath.

4. A method as claimed in claim 3, in which said bending and immersing steps are performed simultaneously but on different portions of the spiral.

5. A method as claimed in claim 1, and bending said carrier to spiral configuration at the same time that another portion of the spiral which has previously been bent to spiral configuration is undergoing immersion in the bath.

6. A cored spiral tube comprising a hollow tubular carrier containing deoxy-desulphurizing substances for introduction into a metallic bath.

* * * * *